US008028375B2

(12) United States Patent
Nakaura et al.

(10) Patent No.: US 8,028,375 B2
(45) Date of Patent: Oct. 4, 2011

(54) PINCH PREVENTION STRUCTURE OF SLIDE DOOR

(75) Inventors: Masaki Nakaura, Hiroshima (JP); Kazuhiro Tanaka, Hiroshima (JP); Yuzo JP Sato, Hiroshima (JP); Hirotaka Kusu, Hiroshima (JP)

(73) Assignee: Mazda Motor Corporation (JP)

( * ) Notice: Subject to any disclaimer, the term of this patent is extended or adjusted under 35 U.S.C. 154(b) by 435 days.

(21) Appl. No.: 12/131,365

(22) Filed: Jun. 2, 2008

(65) Prior Publication Data

US 2009/0000059 A1 Jan. 1, 2009

(30) Foreign Application Priority Data

Jun. 1, 2007 (JP) ..... 2007-147021
Jun. 6, 2007 (JP) ..... 2007-150523

(51) Int. Cl.
*E05F 5/02* (2006.01)

(52) U.S. Cl. ..... 16/82; 318/445; 318/466; 296/146.9; 49/28

(58) Field of Classification Search ..... 16/82, 49, 16/DIG. 17, DIG. 21; 296/146.9, 155; 49/26–28; 318/445, 466
See application file for complete search history.

(56) References Cited

U.S. PATENT DOCUMENTS 5,906,071 A * 5/1999 Buchanan, Jr. ..... 49/360
6,081,088 A * 6/2000 Ishihara et al. ..... 318/466
6,339,305 B1 * 1/2002 Ishihara et al. ..... 318/445
6,955,079 B2 * 10/2005 Ishihara et al. ..... 73/114.01

FOREIGN PATENT DOCUMENTS

DE 19810077 A1 9/1998
JP 09077440 A 3/1997
JP 11-182136 6/1999
JP 2007-056522 8/2007

OTHER PUBLICATIONS

Jeroen Van Kessel; European Search Report; Nov. 5, 2008; EP08010051.

* cited by examiner

*Primary Examiner* — William L. Miller
(74) *Attorney, Agent, or Firm* — Studebaker & Brackett PC; Donald R. Studebaker

(57) ABSTRACT

A slide door is provided to be movable between a closed position to cover a side opening formed at a vehicle-body side face and an open position. The slide door is configured to move outward and subsequently slide rearward along a rear vehicle-body outer face when the slide door moves from the closed position to the open position. There is provided a detection sensor to detect a foreign matter in coming into a gap from a vehicle-compartment inside. A drive of the slide door is stopped in case the detection sensor detects the foreign matter in coming into the gap when the slide door moves toward the open position. Thereby, any foreign matter can be prevented from being pinched in the gap formed between the slide door and the rear edge portion of the side opening.

17 Claims, 14 Drawing Sheets

PINCH PREVENTION STRUCTURE OF SLIDE DOOR

BACKGROUND OF THE INVENTION

The present invention relates to a pinch prevention structure of a slide door.

A vehicle, such as a so-called one-box type of automotive vehicle, is equipped with a slide door that is provided to open and close a side opening formed at a vehicle-body side face, through which a passenger gets onto or gets off from a rear seat. The slide door is generally configured to move outward and subsequently slide rearward along a rear vehicle-body outer face when the slide door moves from its closed position to its open position. The slide door may be driven by an electric motor.

Herein, when the slide door is moved from the closed position to the open position, a gap is formed between an inner side face of the slide door and a rear edge portion of the side opening. Japanese Patent Laid-Open Publication No. 2007-56522 discloses a pressure sensitive sensor that is provided at the inner side face of the slide door to detect a load that occurs in a vehicle width direction thereof when any foreign matter is pinched in this gap. This publication also discloses an electrically-driven slide-door control, in which when this foreign-matter pinch is detected, the drive of the slide door is stopped or its drive direction is reversed. Meanwhile, Japanese Patent Laid-Open Publication No. 11-182136 discloses another pinch detection by a pressure sensitive sensor that is provided at a front edge portion of the slide door to detect any foreign matter when the slide door moves from the open position to the closed position (detection of pinch between the slide door and the front edge portion of the side opening).

The above-described publications just disclose the foreign-matter pinch detection itself, but not disclose any effective measures to prevent the foreign-matter pinch properly.

SUMMARY OF THE INVENTION

The present invention has been devised in view of the above-described problem, and an object of the present invention is to provide a pinch prevention structure of a slide door that can prevent any foreign matter from being pinched in the gap formed between the slide door and the rear edge portion of the side opening when the slide door is moved from the closed position toward the open position.

According to the present invention, there is provided a pinch prevention structure of a slide door, comprising a slide door provided to be movable between a closed position in which the slide door covers a side opening formed at a vehicle-body side face and an open position in which the slide door opens the side opening, the slide door being configured to move outward and subsequently slide rearward along a rear vehicle-body outer face when the slide door moves from the closed position to the open position, a drive device operative to drive the slide door so as to move between the closed position and the open position, a drive control device operative to control the drive device, and a detection sensor operative to detect a foreign matter in coming into a gap from a vehicle-compartment inside, which is formed between an inner side face of the slide door and a rear edge portion of the side opening when the slide door is moved from the closed position toward the open position, wherein the drive control device is configured so that a drive of the slide door by the drive device is stopped in case the detection sensor detects the foreign matter in coming into the gap when the drive device drives the slide door in the closed position toward the open position. According to the present invention, when the foreign matter is about to come into the gap from the vehicle inside, the detection sensor detects such foreign matter and thereby the drive of the slide door toward the open position is stopped. Thereby, any foreign matter can be prevented from being pinched in the gap properly.

According to an embodiment of the present invention, the rear edge portion of the side opening includes a rear-edge front face portion that faces forward and a rear-edge side face portion that extends forward from an inside end of the rear-edge front face portion, the rear-edge front face portion and the rear-edge side face portion forming an open edge portion that is recessed toward the vehicle inside, at the open edge portion is provided a cover member that is operative to extend in a vehicle width direction so as to cover part of the gap formed when the slide door is moved from the closed position toward the open position, and the detection sensor is configured to detect the foreign matter in contacting the cover member in an operative position from the front. Thereby, since the cover member is located at the operative position so as to cover part of the gap when the slide door is moved from the closed position toward the open position, it can be surely prevented that any object (foreign matter) located inside the vehicle from coming into the gap. Further, the cover member itself can be utilized as means for detecting any foreign matter. Also, since the cover member is disposed by properly using a space of the recessed open edge portion that is recessed, there may be no need to provide any particular layout space for the cover member.

According to another embodiment of the present invention, the cover member is comprised of a plate member that extends substantially vertically and configured to operate so as to cover the part of the gap in connection with the slide door moving from the closed position to the open position. Herein, the plate member may be preferable in providing a simple and small-sized cover member. Further, since the cover member operates cover the part of the gap in connection with the slide door moving from the closed position to the open position, the cover can be covered by the cover member surely.

According to another embodiment of the present invention, the cover member is provided so as to rotate around a vertically-extending axis between the operative position in which the cover member extends in the vehicle width direction and a store position in which the cover member extends in a vehicle longitudinal direction, a biasing means for biasing the cover member toward the operative position is provided, and the detection sensor is configured to detect the foreign matter in response to a rearward move of an outside end portion of the cover member in the operative position receives an outer force from the front that is greater than a biasing force of the biasing means. Herein, the cover member can be automatically changed in position between the operative position and the store position in connection with the slide door moving with a simple structure using the rotation and the biasing means. Further, a situation in which any foreign matter comes into the gap can be detected surely by properly using the rearward move of the outside end portion of the cover member in the operative position.

According to another embodiment of the present invention, the cover member, which is comprised of a plate member that extends substantially vertically, is supported by a vehicle body at an inside end portion thereof that is held rotatably around a vertically-extending axis so that the cover member moves between the operative position and a store position in which the cover member extends in a vehicle longitudinal direction along the rear-edge side face portion of the open edge portion, a biasing means for biasing the cover member toward the operative position is provided, and the cover member is configured such that the cover member is rotated toward the operative position by the biasing means when the slide door is moved toward the open position from the closed position, while the cover member is pushed by the slide door so as to come to the store position when the slide door is moved toward the closed position from the open position. Herein, the plate member may be preferable in providing a simple and small-sized cover member. The cover member can be automatically changed in position between the operative position and the store position in connection with the slide door moving with the simple structure using the rotation and the biasing means.

According to another embodiment of the present invention, the cover member is configured such that an outside end portion thereof in the operative position has a contour that corresponds to a contour of the inner side face of the slide door. Herein, the gap can be preferably covered in a properly wide range in the vehicle width direction, preventing interference of the slide door moving toward the open position with the cover member in the operative position.

According to another embodiment of the present invention, an armrest is formed at the inner side face of the slide door so as to project, and the cover member is configured to cover the gap at least at a level of an upper face of the armrest. Herein, a situation in which an object (foreign matter) placed on the armrest would come into the gap can be prevented surely.

According to another embodiment of the present invention, an armrest is formed at the inner side face of the slide door so as to project, and an outside end portion of the cover member in the operative position has a notch with a contour that corresponds to a contour of the armrest. Herein, any interference of the armrest with the cover member can be prevented, allowing the passenger to use the armrest at the slide door in the closed position. Further, while the gap may become considerably wide in the vehicle width direction because the slide door with the armrest needs to move outward enough to avoid interference of the armrest with the vehicle body for its closing, the cover member can cover the wide gap properly and thereby the pinch can be prevented surely.

Other features, aspects, and advantages of the present invention will become apparent from the following description which refers to the accompanying drawings.

DETAILED DESCRIPTION OF THE INVENTION

Figure 1:
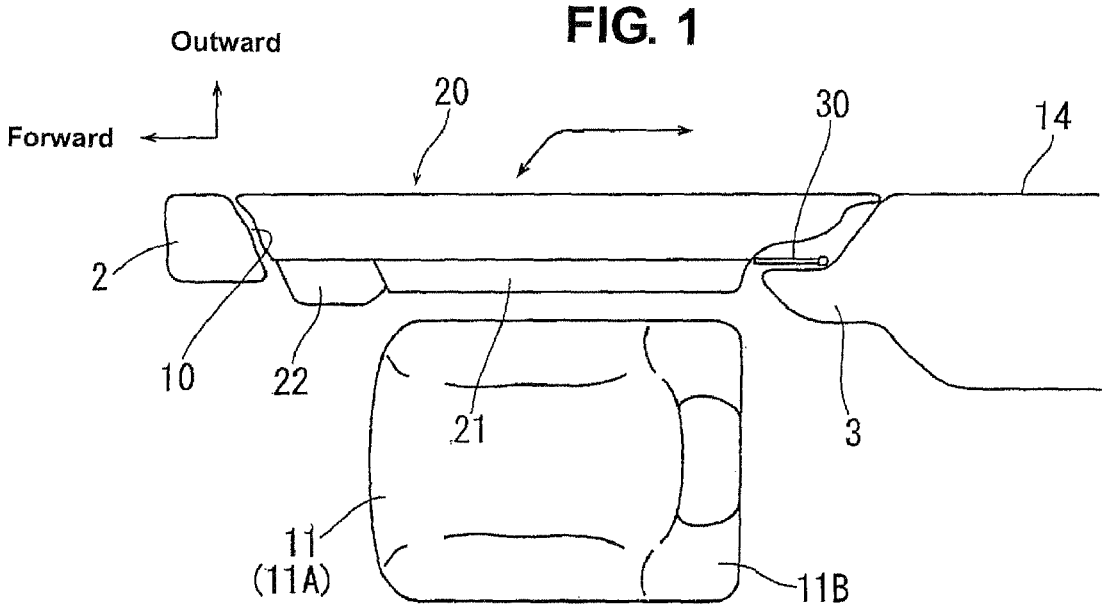
FIG. 1 is a brief plan view showing a slide door in a closed position and a cover member in a store position according to a first embodiment of the present invention.

Hereinafter, preferred embodiments of the present invention will be described referring to the accompanying drawings.

Embodiment 1

In FIGS. 1 through 4, reference character 1 denotes a vehicle body, 2 denotes a B pillar (center pillar), 3 denotes a C pillar that is located right behind the B pillar 2, and 4 denotes a rearmost D pillar that is located behind the C pillar 3.

Figure 3:
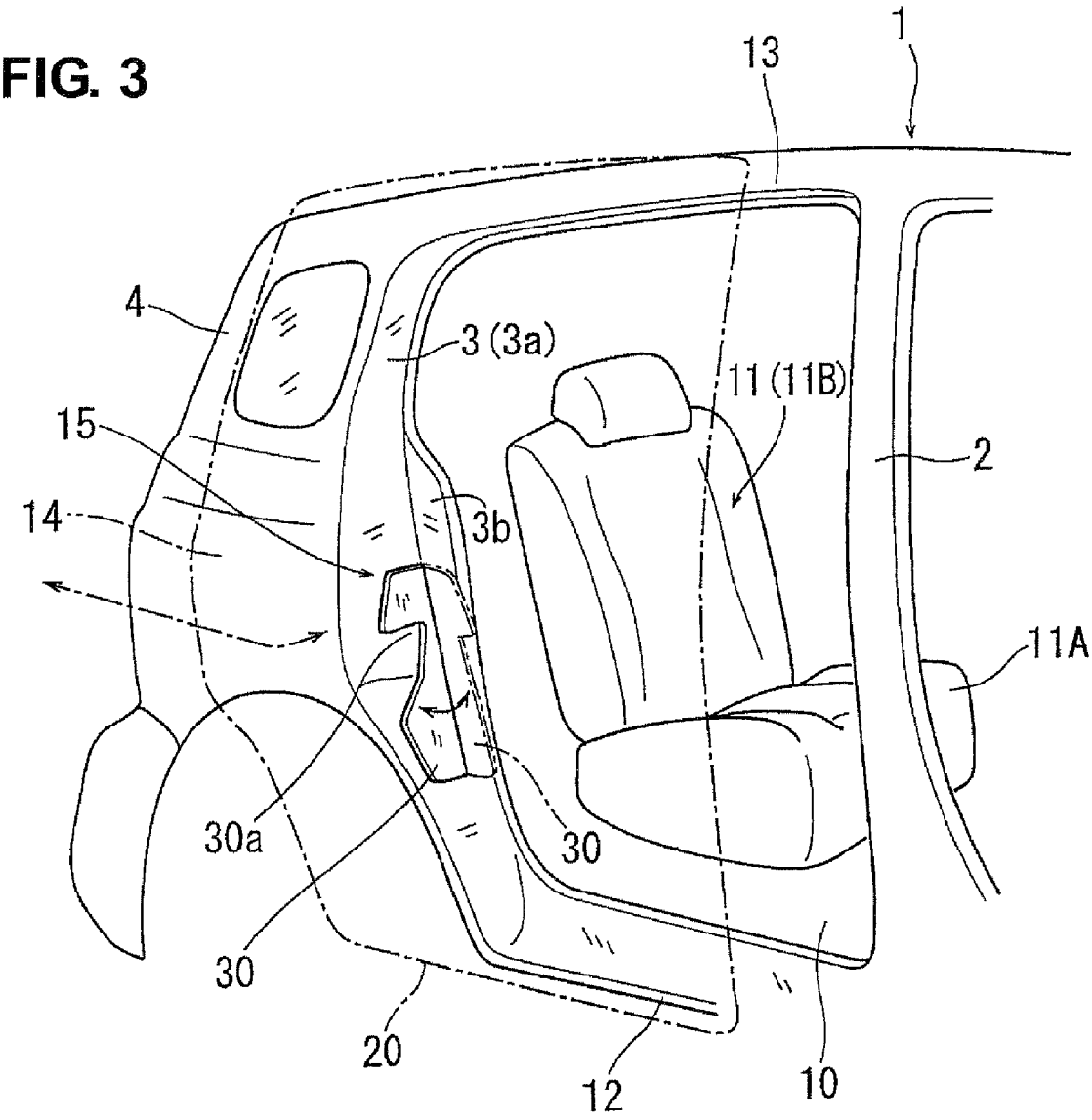
FIG. 3 is a perspective view showing a side opening and the cover member.

As apparent from FIG. 3 particularly, a side opening 10 is formed at a vehicle-body side face between the B pillar 2 and the C pillar 3. A front edge portion of the side opening 10, which is for ingress and egress of a passenger for a rear seat (second-row seat) 11, is comprised of the B pillar 2, its rear edge portion is comprised of the C pillar 3, its lower edge portion is comprised of a side sill 12, and its upper edge portion is comprised of a roof side rail (outer end portion of a roof panel) 13.

Figure 2:
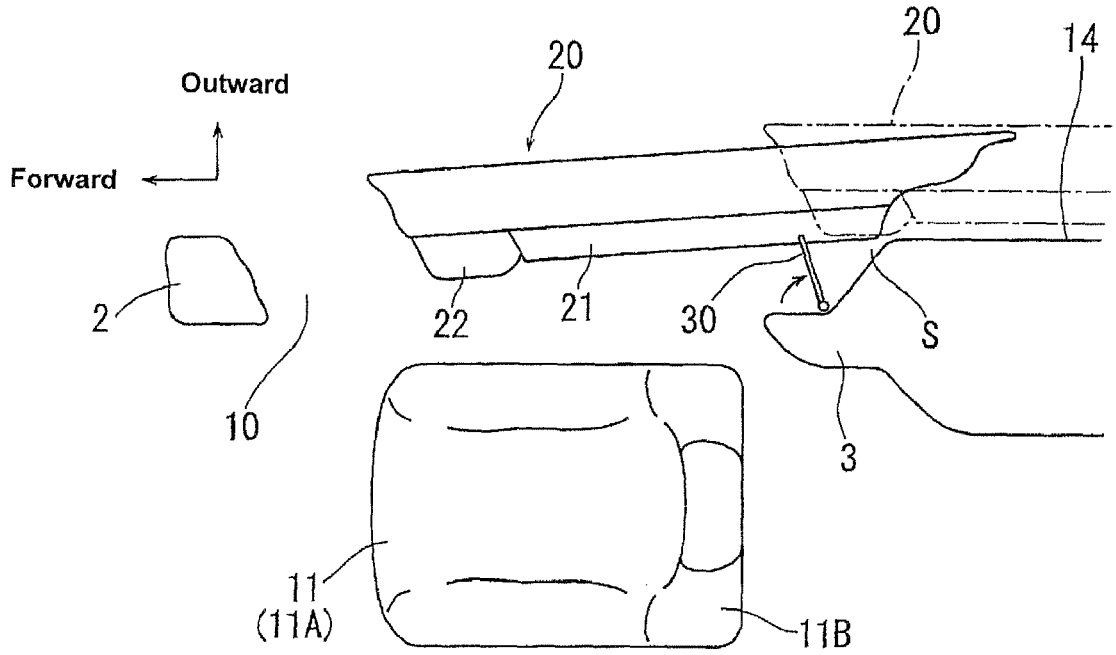
FIG. 2 is a brief plan view showing a state in which the slide door is moved toward an open position from a state shown in FIG. 1.

The side opening 10 is opened and closed by a slide door 20. That is, the slide door 20 is configured to take a closed position in which the side opening 10 is closed by it (a state shown in FIG. 1) and an open position in which the side opening 10 is opened by it. More specifically, the slide door 20 is configured to move outward and subsequently slide rearward along a rear fender 14 when the slide door 20 moves from the closed position shown in FIG. 1 to the open position in which the side opening 10 is almost fully opened (a move shown by an arrow in FIG. 1). FIG. 2 shows a state in which the slide door 20 moves outward and subsequently slides rearward slightly toward the open position. A return of the slide door 20 from the open position to closed position follows a move that is reverse to the opening move of the slide door 20. The slide door 20 is comprised of an electrically-driven type of door that is opened and closed by a motor, which will be described below.

The C pillar 3 forming the rear edge portion of the side opening 10 includes a rear-edge front face portion 3*a* and a rear-edge side face portion 3*b* that extends forward from an inside end of the rear-edge front face portion 3*a*. An outside end of the rear-edge front face portion 3*a* is connected to a front end of the rear fender 14. Thus, the rear-edge front face portion 3*a* and the rear-edge side face portion 3*b* form an open edge portion 15 that is slightly recessed toward the vehicle inside from the rear fender 14 forming the vehicle-body outer face. An open edge portion that corresponds to the open portion edge is also formed at the B pillar 2, side sill 12 and roof side rail 13.

The slide door 20 in the closed position is stored in the open edge portion 15 so that an outer face of the slide door 20 can be flush with the rear fender 14. In other words, a degree (a vehicle-width-direction size) of the recess forming of the open edge portion 15 (rear-edge front face portion 3*a*) toward the vehicle inside is set in accordance with a thickness of the slide door. And, the longitudinal size of the rear-edge side face portion 3*b* is set so as to provide a proper water proof (sealing).

Figure 4:
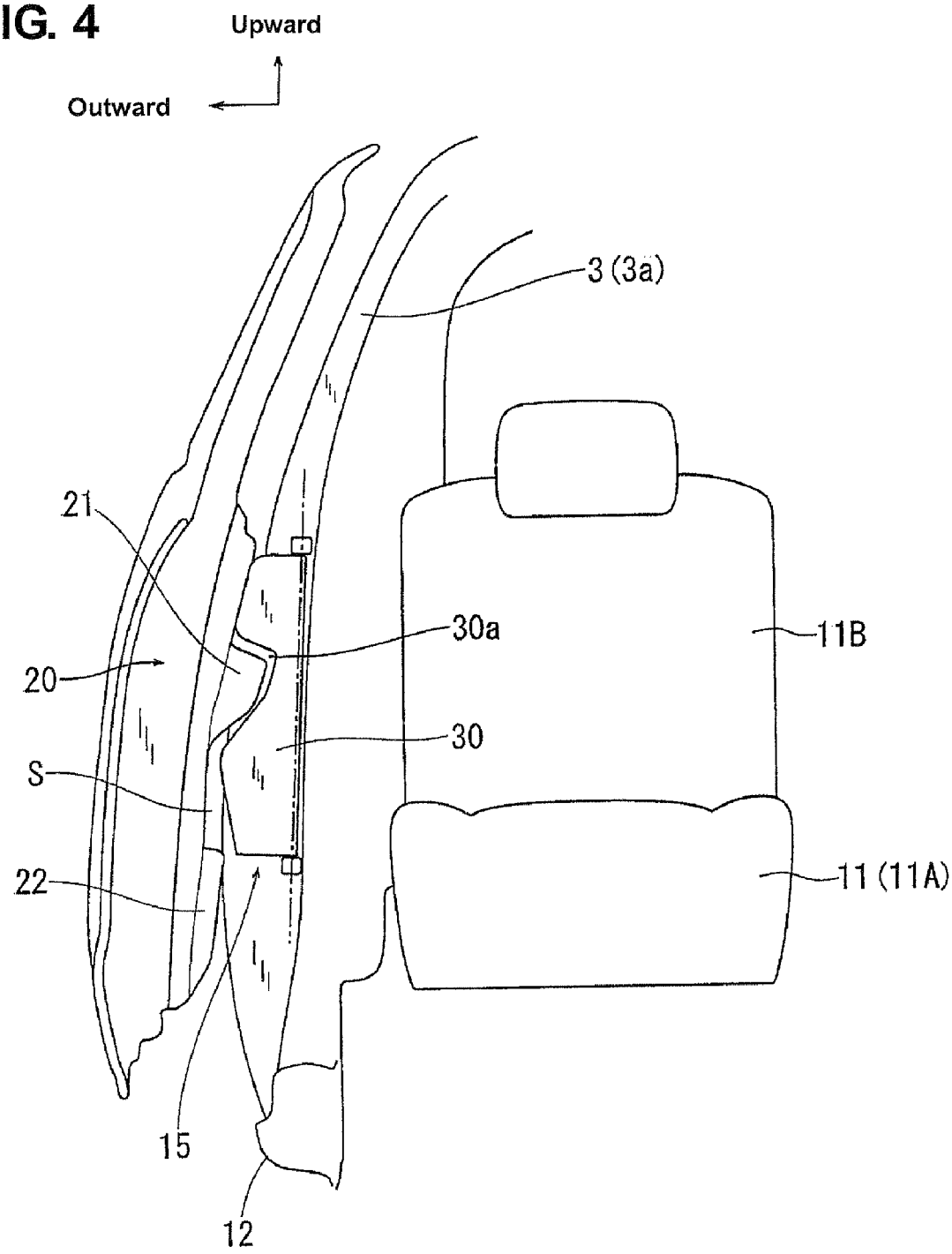
FIG. 4 is a view, when viewed from the front, showing a state in which the cover member covers a gap that is formed when the slide door is opened, when viewed from the front.

At an inner face of the slide door 20 are formed an armrest 21 and a storage box 22 for bottles or the like that is located before the armrest 21. As shown in FIG. 4, the armrest 21 is provided so that its upper face is positioned at a slightly higher level than a seat face of a seat cushion 11A of the rear seat 11 (at a middle position of a seat back 11B). The storage box 22 is provided so that its upper face is positioned substantially at the same level as the seat face of the seat cushion 11A. However, respective positions of these members 21, 22 may be set at any level instead.

At the open edge portion 15 is provided a cover member 30. The cover member 30 is made of synthetic resin or light metal, for example, so as to have rigidity as a whole, and comprised of a plate member that extends substantially vertically according to the present embodiment. The cover member 30 can take an operative position in which it extends in the vehicle width direction as shown by solid lines in FIGS. 2 and 3, and a store position in which it extends in the vehicle longitudinal direction as shown by one-dotted broken lines in FIGS. 1 and 3. Thus, the cover member 30 in the operative position is positioned so as to extend along the rear-edge front face portion 3*a*. Meanwhile, the cover member 30 in the store position is positioned so as to extend along the rear-edge side face portion 3*b*.

The cover member 30 in the operative position is supported by the vehicle body (C pillar 3) at its inside end portion that is held rotatably around a vertically-extending axis. The cover member 30 is biased toward the operative position as described below. Thereby, the cover member 30 can be automatically rotated toward the operative position in connection with the slide door 20 moving from the closed position to the open position. When the slide door 20 moves from the open position to the closed position, the cover member 30 is pushed toward the store position by the slide door 20.

Figure 5:
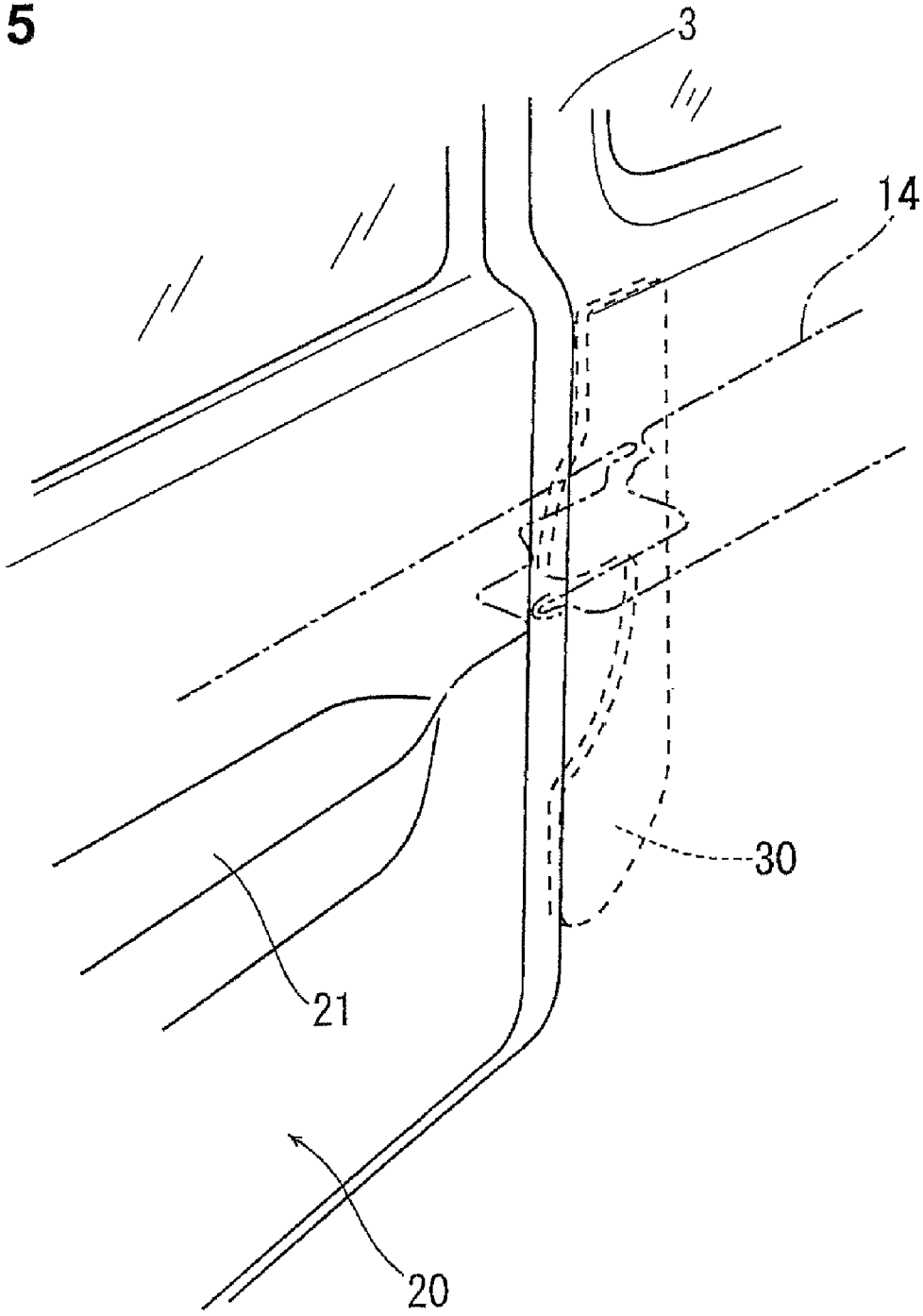
FIG. 5 is a perspective view showing the cover member in a store position at a state in which the slide door is in the closed position.
Figure 6:
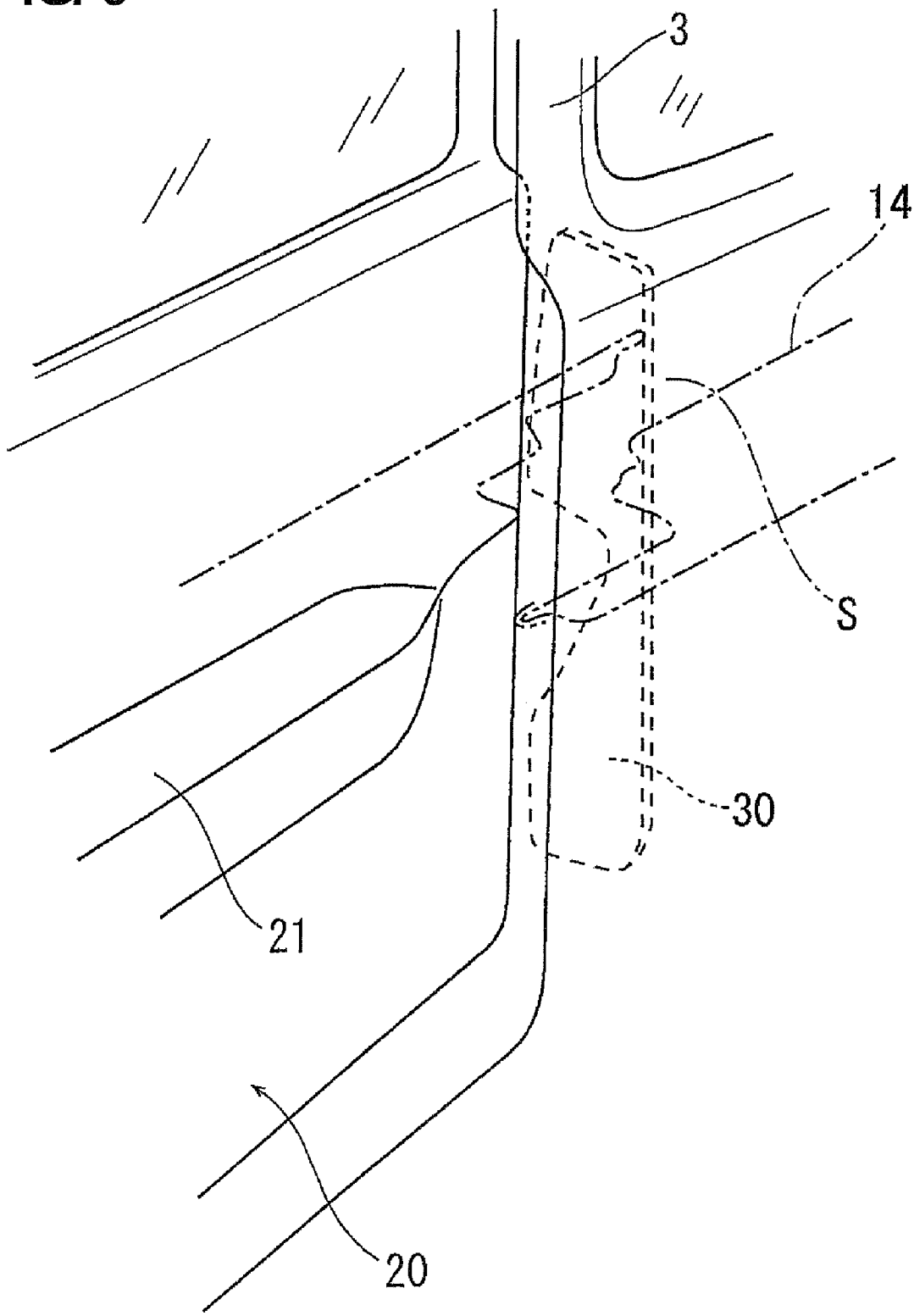
FIG. 6 is a perspective view showing the cover member in an operative position when the slide door is opened from state shown in FIG. 5.

FIG. 5 shows the cover member 30 in the store position, in which its sectional structure near the C pillar 3 at a level of the upper face of the armrest 21 is shown briefly by a one-dotted broken line. FIG. 6 shows the cover member 30 in the operative position, in which its sectional structure near the C pillar 3 at the level of the upper face of the armrest 21 is shown briefly by a one-dotted broken line.

A gap S is formed between the inner side face of the slide door 20 and the C pillar 3 (its outer side end) when the slide door 20 is moved from the closed position to the open position (see FIGS. 2, 4 and 6). The gap S is covered from the front by the cover member 30 that is moved automatically to the operative position in connection with the forming of the gap S (the moving of the slide door 20 from the closed position to the open position). The cover member 30 is provided so that it can cover the gap S in a range that corresponds to a level of the passenger seated in the rear seat 11. That is, the cover member 30 covers the gap S in the range from the level of the seat face of the seat cushion 11A to a level that is slightly below an upper end of the seat back 11B in its upright position. More specifically, a situation in which any object, as a foreign matter, is placed on the armrest 21 may happen frequently. Herein, it may become likely that such any object on the armrest 21 comes into the gap S inadvertently when the slide door 20 is opened. Accordingly, the cover member 30 that covers the level range around the upper face of the armrest 21 of can properly prevent such any object from coming into the gap S.

In particular, as apparent from FIG. 4, the cover member 30 is configured such that an outside end portion of the cover member 30 in the operative position has a contour that corresponds to a contour of the inner side face of the slide door 20. Specifically, the outside end portion of the cover member 30 in the operative position has a notch 30*a* with a contour that corresponds to a contour of the arrest 21. Thereby, the gap S can be preferably covered by the cover member 30 in a properly wide (long) range in the vehicle width direction, preventing interference of the slide door 20 moving from the closed portion toward the open position.

Figure 7:
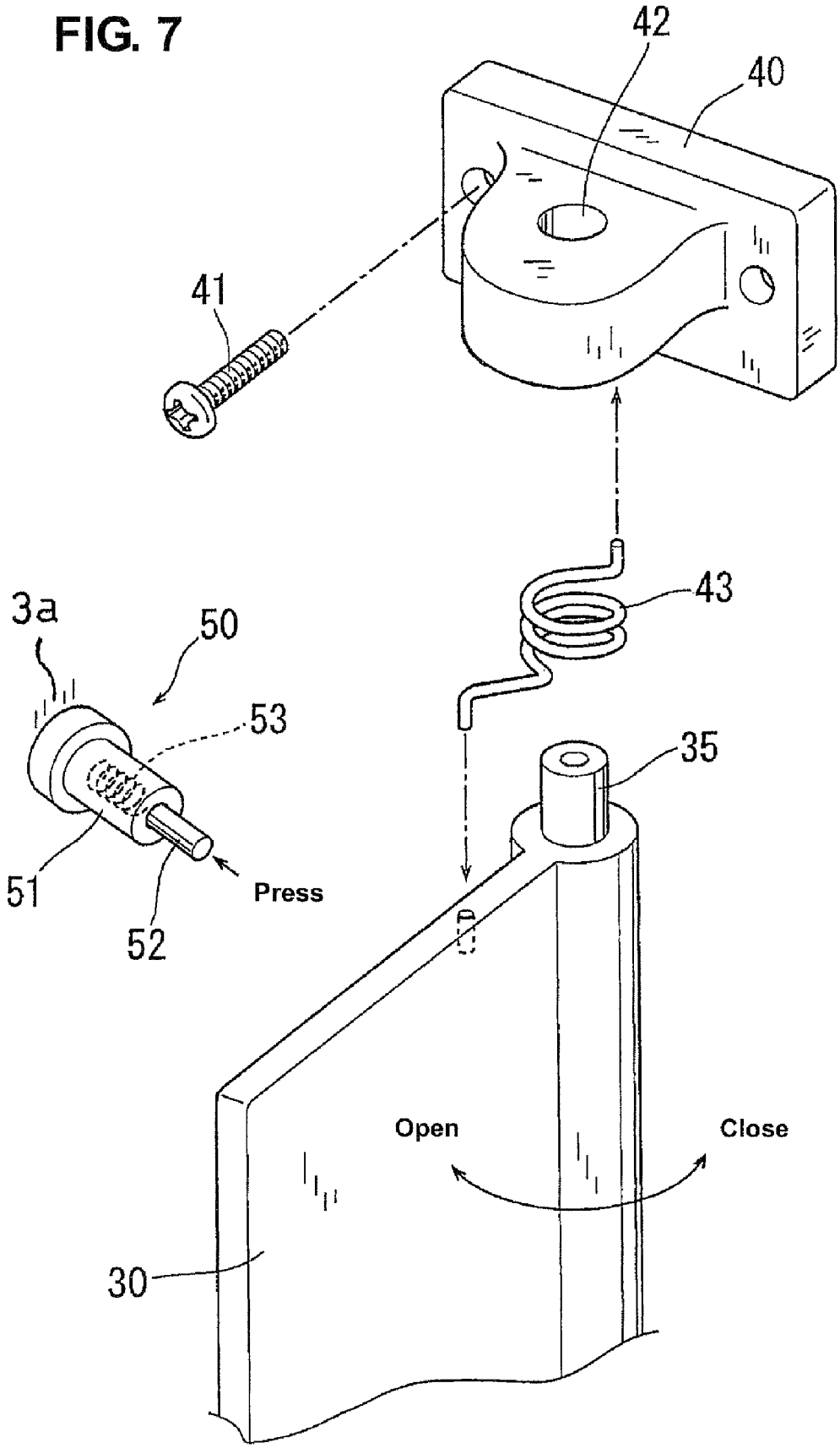
FIG. 7 is an exploded perspective view of an exemplified major portion for attaching the cover member to a vehicle body.
Figure 8:
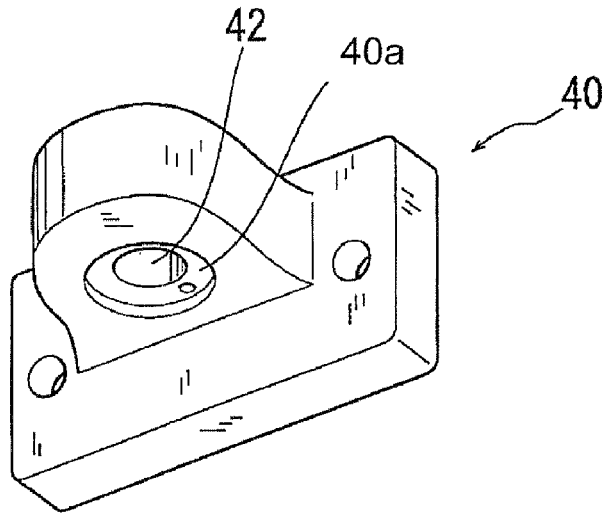
FIG. 8 is a perspective view of a holding bracket shown in FIG. 7.
Figure 9:
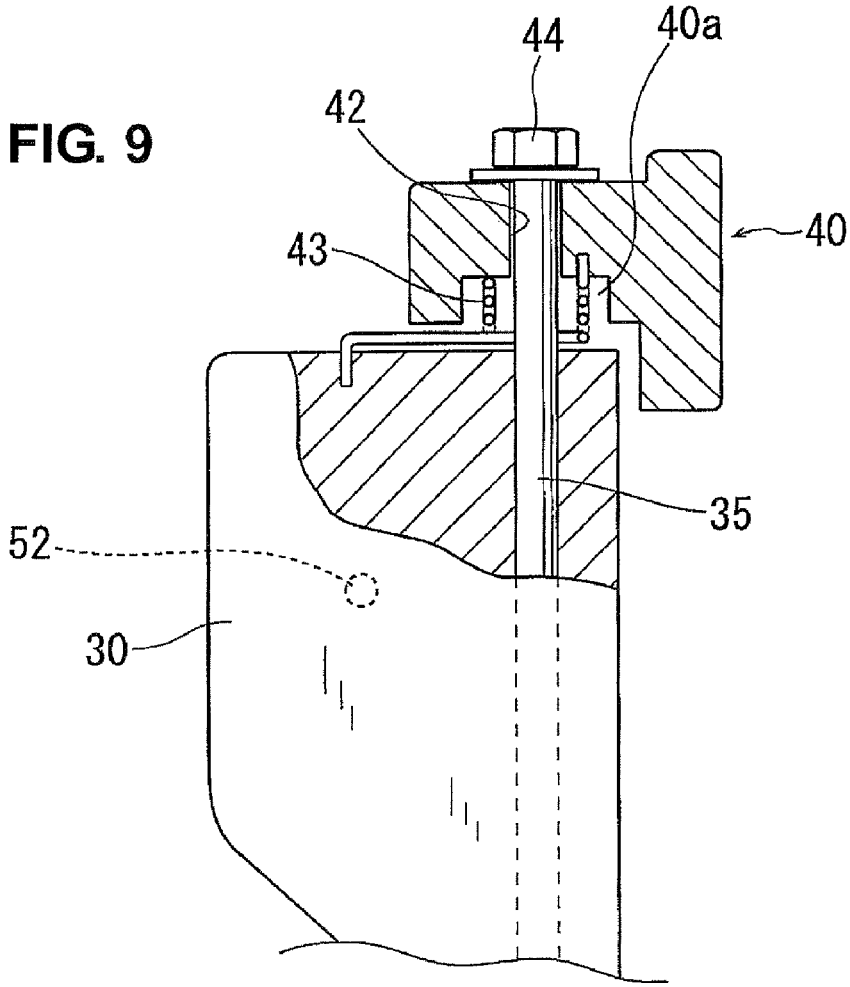
FIG. 9 is a sectional view of the major portion showing an attachment relation between the cover member and the holding bracket.

FIGS. 7 through 9 show an example of concrete attachment of the cover member 30 to the vehicle body. At the inside end portion of the cover member 30 in the operative position is held a vertically-extending support axis 35. The support axis 35 is rotatably supported by a pair of holding brackets 40 at its upper and lower end portions. Since the both brackets have the same structure, an attachment relation between the cover member 30 and the upper holding bracket 40 will be described.

The holding bracket 40 is fixed to the vehicle body (the open edge portion 15) with a fixing tool 41 such as a bolt. The above-described support axis 35 is inserted into a holding hole 42 that is formed at the holding bracket 40, and prevented from getting out by a screw 44. At a lower face of the holding bracket 40 is formed a recess 40*a*, where a coil spring 43 as a biasing means is disposed. The coil spring 43 is provided so as to surround the support axis 35. One end of the coil spring 43 engages with the holding bracket 40, and the other end engages with the cover member 30. The cover member 30 is biased toward the operative position by the coil spring 43.

There is provided a pressure sensitive switch 50 as a detection sensor shown in FIG. 7, for example, to detect that a rearward outer force that is a specified value or greater acts on the cover member 30 in the operative position. The pressure sensitive switch 50, for example, comprises a casing 51 that is fixed to the rear-edge front face portion 3*a*, a contact 52 that is movable longitudinally relative to the casing 51, a spring 53 that is disposed in the casing 51 and biases the contact 52 forward, and a switch (not illustrated) that is disposed in the casing 51 and turns on when the contact 52 is moved rearward by a specified distance. The contact 52 is located right behind the cover member 30 in the operative position.

Herein, a biasing force of the spring 53 of the pressure sensitive sensor 50 is set to be greater than the one of the coil spring 43. Accordingly, when the rearward outer force that is the specified value or greater acts on the cover member 30 in the operative position, the pressure sensitive switch 50 turns on, so it is detected that the great rearward outer force acts on the cover member 30. And, as described below, when the pressure sensitive switch 50 turns on, the move of the slide door 20 toward the open position is forced to stop. Herein, the cover member 30 in the operative position is made contact the contact 52 of the pressure sensitive switch 50 by the biasing force of the coil spring 43. In this state, when the rearward outer force that is the specified value or greater acts on the cover member 30 rearward, the cover member 30 is rotated slightly pushing the contact 52 rearward, but its further rearward rotation is prevented by the pressure sensitive switch 50 (the rear-edge front face portion 3*a* to which the pressure sensitive switch 50 is attached). Thus, the cover member 30 has a function as the foreign-matter detection to operate the pressure sensitive switch 50 and a function of preventing any foreign matter from coming into the gap S.

Figure 10:
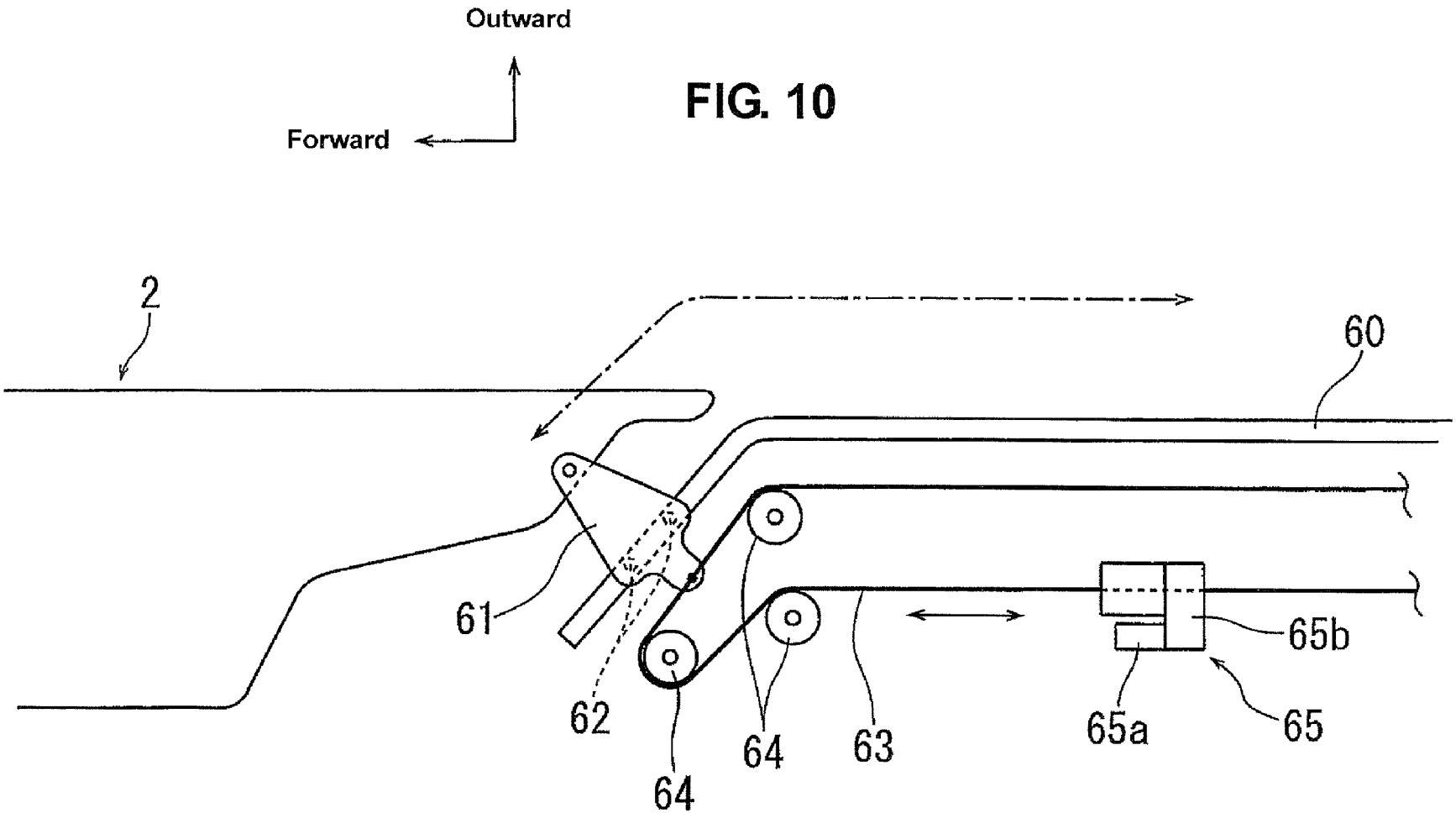
FIG. 10 is a brief plan view of an exemplified portion for driving the slide door.

FIG. 10 shows an exemplified portion for driving the electrically-driven slide door 20. In this figure reference character 60 denotes a guide rail, which is fixed to the vehicle body so as to extend from the open edge portion 15 along the rear fender 14. Rollers 62, such as a pulley, which are held at a bracket 61 that is rotatably supported at a rear end portion of the slide door 20, are disposed in the guide rail 60 so as to move smoothly inside the guide rail 60.

A guide wire 63 is connected to the above-described bracket 61. The guide wire 63 is disposed with a guide pulley 64 so as to extend along the guide rail 60. The guide wire 63 is made to reciprocate by a drive mechanism 65, which comprises a motor 65*a*, a reduction mechanism 65*b*, and a drive pulley (not illustrated) that engages with the guide wire 64. The drive pulley is rotated in both (normal and reverse) directions by the motor 65*a* via the reduction mechanism 65*b*, thereby making the guide wire 63 reciprocate. The reciprocation of the guide wire 63 drives the slide door 20 between the closed position and the open position.

Figure 11:
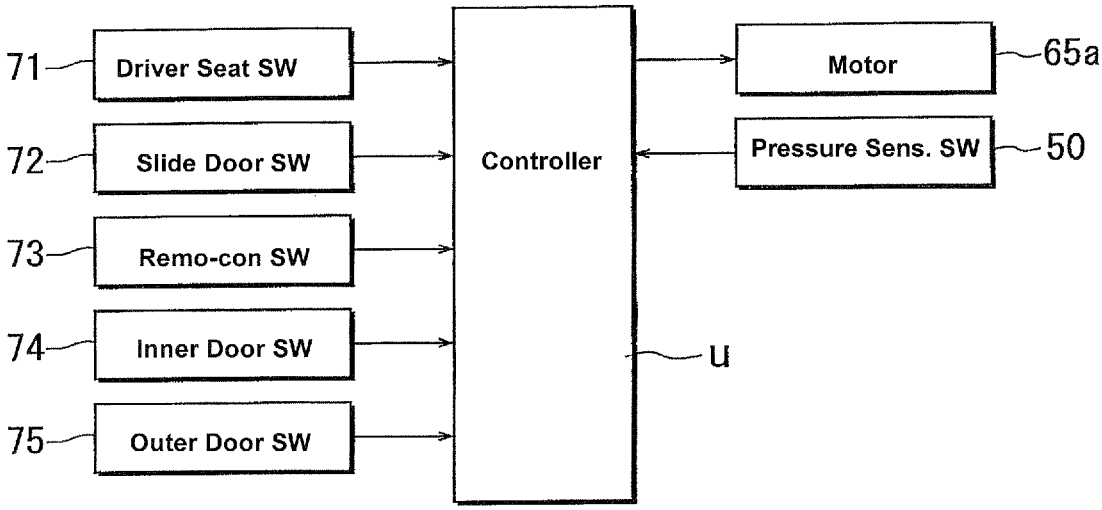
FIG. 11 is a block diagram showing an exemplified control system of the present invention.

FIG. 11 shows a control system of the motor 65*a*, in which reference character U denotes a controller (control unit) using a micro computer. Signals of the pressure sensitive switch 50 and other various switches 71 through 75 are inputted to the controller U. The respective switches 71 through 75 are manually operated for commanding the opening and closing of the slide door 20. The switch 71 is provided at a driver seat, the slide-door switch 72 is provided at the inner face of the slide door 20, and the remote control switch 73 is portable by the passenger. The inner-door switch 74 is provided at the inner side face of the side door 20 and attached to an inner door handle that is operated by the passenger seated in the rear seat 11 by adding an operational force. Likewise, the outer-door switch 75 is provided at the outer side face of the side door 20 and attached to an outer door handle that is operated by the passenger who wants to seat in the rear seat 11 by adding an operational force. Part of the above-described switches may be used, not all of them.

When the controller U receives a command signal of opening from ay one of the switches 71 through 75 while the slide door 20 is in the closed position, it executes a control of driving the motor 65*a* so as to open the slide door 20. When the pressure sensitive switch 50 turns on while the slide door 20 moves from the closed position to the open position, the driving of the slide door 20 toward the open position is made stop. Herein, the slide door 20 may be controlled so as to go back slightly toward the closed position after this driving stop.

Figure 12:
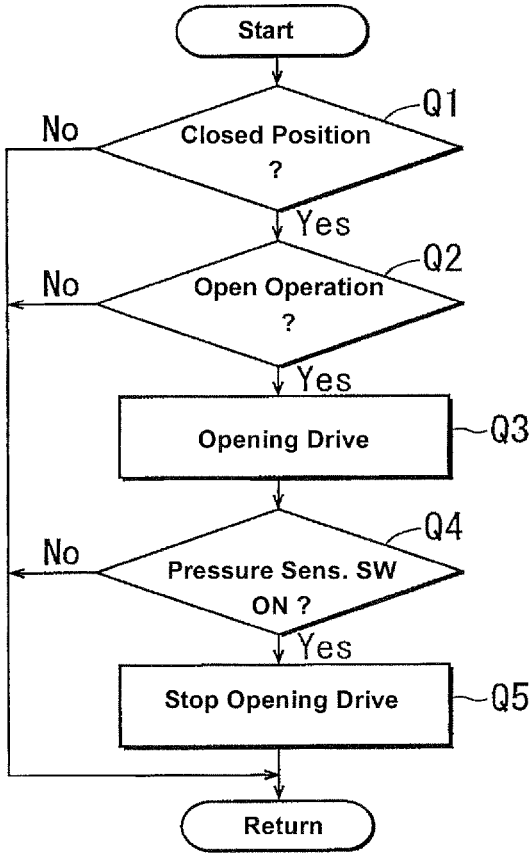
FIG. 12 is a flowchart showing an exemplified control of the present invention.

The control content of the controller U is shown by a flowchart in FIG. 12. Hereinafter, reference character Q denotes each step in the flowchart. And, the control sequence starts with a premise that the vehicle speed is zero (vehicle stop) for safety. First, in step Q it is determined whether the slide door 20 is currently in the closed position or not. When the determination in the step Q is YES, it is determined in step Q2 whether or not the command signal of opening is received from any one of the switches 71 through 75. When the determination in the step Q2 is YES, the side door 20 is driven toward the open position (driving of the motor 65*a*) in step Q3. Then, it is determined in step Q4 whether or not the pressure sensitive switch 50 turns on. When the determination in the step Q4 is YES, the driving of the side door 20 toward the open position is forced to stop automatically. Herein, the slide door 20 may be controlled so as to go back slightly toward the closed position after the driving stop as described above. When the determination in the step Q1 is NO and the determination in the step Q2 is NO, or when the determination in the step Q4 is NO, the control sequence returns without having going through step Q5 (the slide door 20 is driven to the open position).

Embodiment 2

Figure 13:
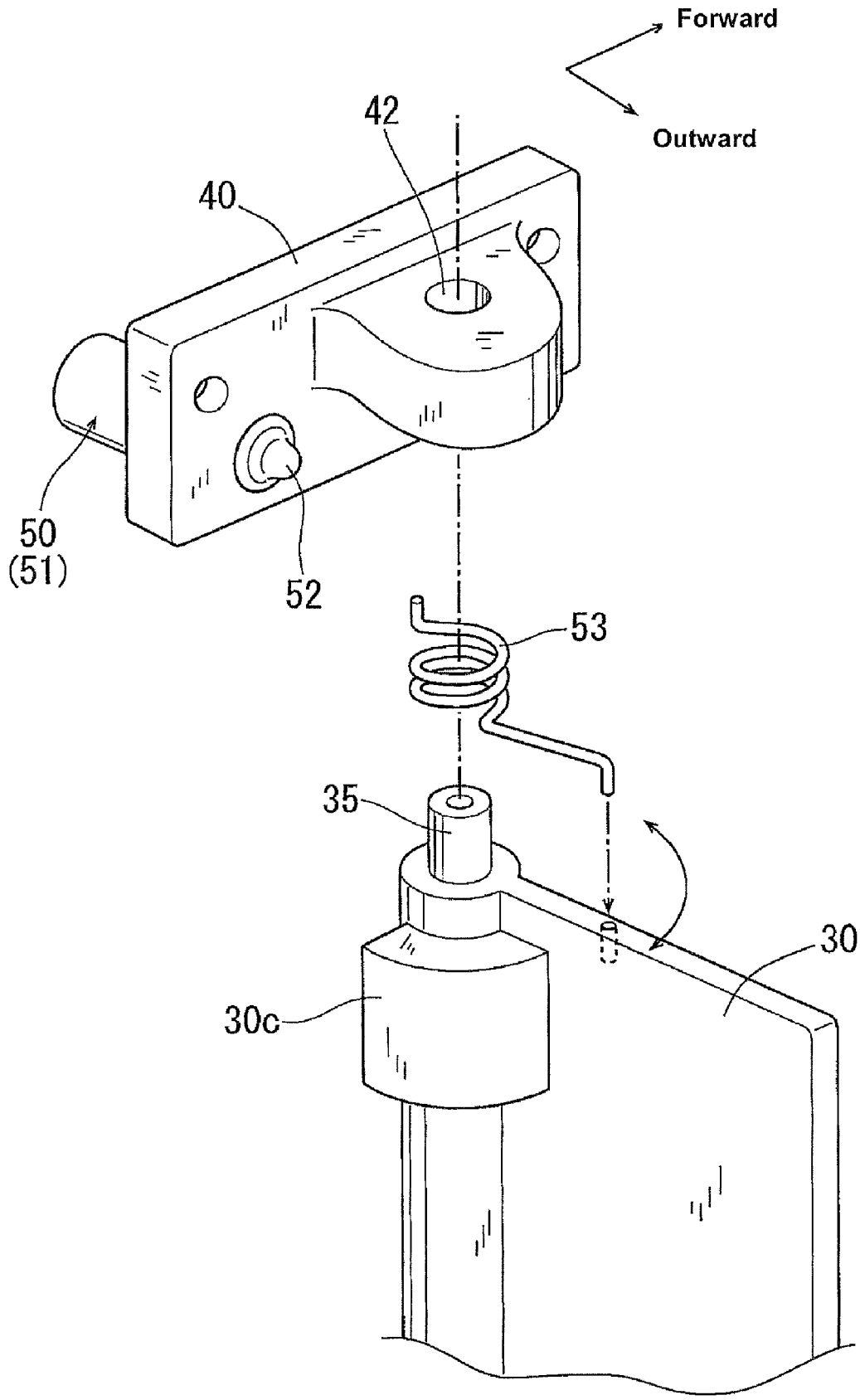
FIG. 13 is a perspective showing a second embodiment of the present invention, which corresponds to FIG. 7.
Figure 14:
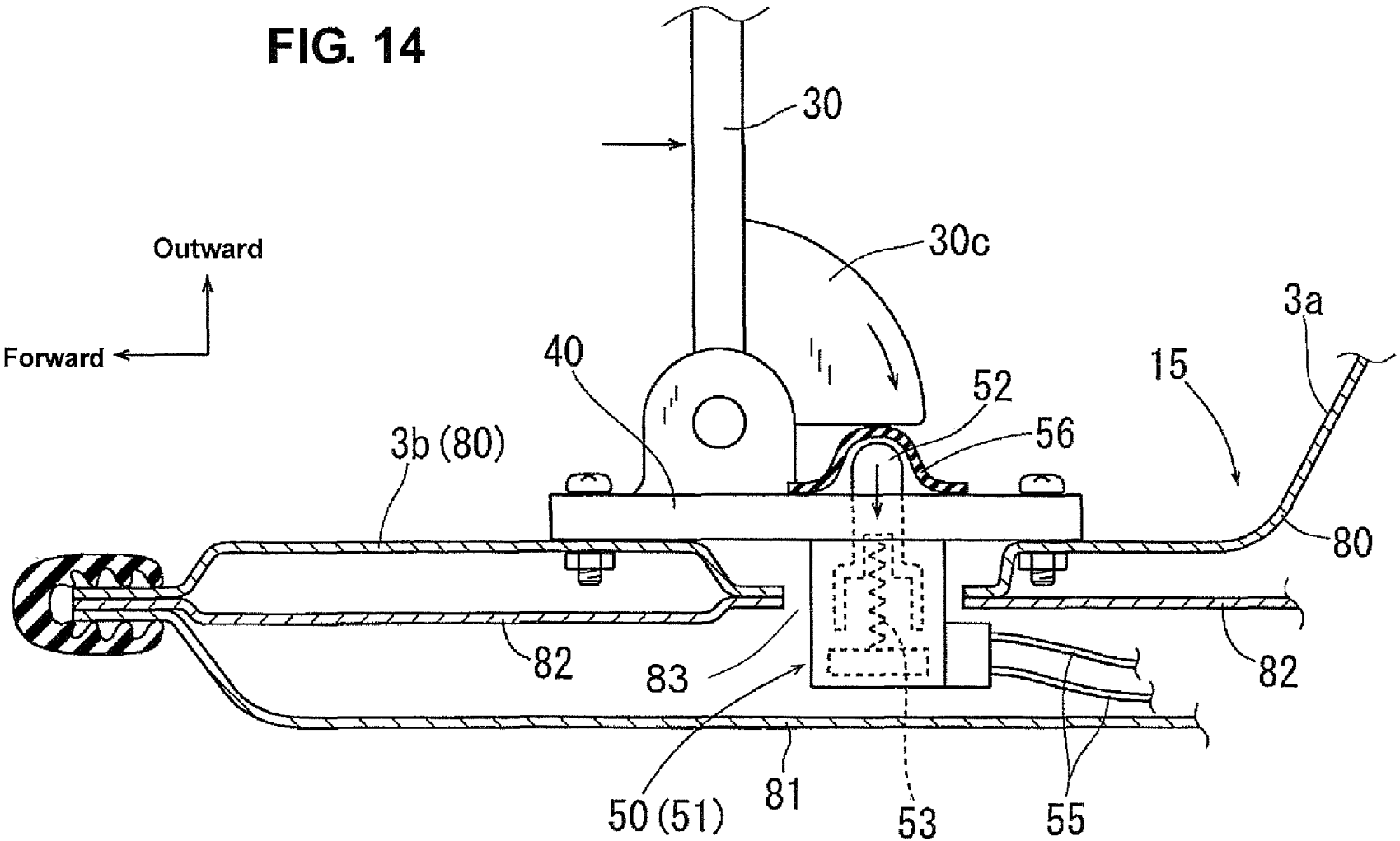
FIG. 14 is a sectional view of an exemplified major portion for attaching a pressure sensitive switch to the vehicle body according to the second embodiment of the present invention shown in FIG. 13.

FIGS. 13 and 14 show a second embodiment of the present invention. Herein, the same structure elements as those in the above-described first embodiment are denoted by the same reference characters, and duplicated descriptions on those are omitted here. In the present embodiment, the pressure sensitive switch 50 is attached to the rear-edge side face portion 3*b* of the open edge portion 15. That is, as shown in FIG. 14, the holding bracket 40 is fixed to the rear-edge side face portion 3*b*, and the casing 51 of the pressure sensitive switch 50 is fixed to the holding bracket 40. The contact 52 of the pressure sensitive switch 50 faces outward. Herein the contact 52 (its tip portion) is sealed from the outside with a seal member 56.

Meanwhile, a pressing portion 30*c* is formed at the cover member 30 so as to project from a portion of the cover member 30 that is located near its rotational center and at a level that corresponds to the disposition level of the holding bracket 40 (pressure sensitive switch 50). The pressing portion 30*c* comes to contact or approach to the contact 52 of the pressure sensitive switch 50 when the cover member 30 is in the operative position. Accordingly, when the rearward outer force that is the specified value or greater acts on the cover member 30 in the operative position that is biased with the coil spring 43 as the biasing means, the cover member 30 is rotated rearward slightly to push the pressure sensitive switch 50, so that the pressure sensitive switch 50 turns on (operates). Herein, the biasing force of the coil spring 43 is relatively small, so the pressure sensitive switch 50 does not turn on unless the rearward outer force that is the specified value or greater acts on the cover member 30.

In FIG. 14, which shows an example of panel structure that forms the open edge portion 15 (rear-edge side face portion 3*b*), reference character 80 denotes an outer panel, reference character 81 denotes an inner panel, and reference character 82 denotes a reinforcement. At the outer panel 80 and the reinforcement 82 are formed attachment holes 83 for the pressure sensitive switch 50. Codes 55 of the pressure sensitive switch 50 are disposed between the inner panel 81 and the reinforcement 82.

Embodiment 3

Figure 15:
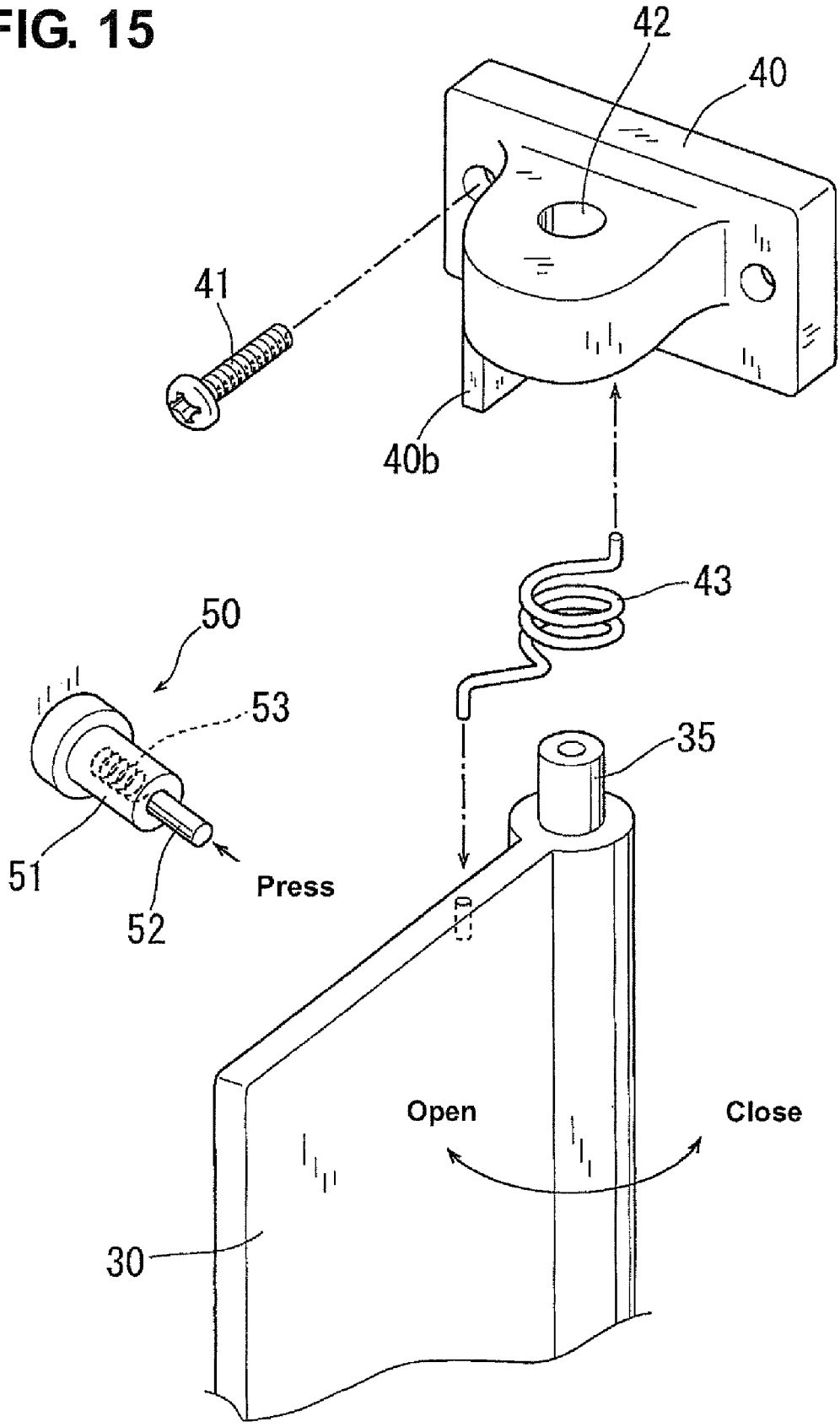
FIG. 15 is a perspective view showing a third embodiment of the present invention, which corresponds to FIG. 7.
Figure 16:
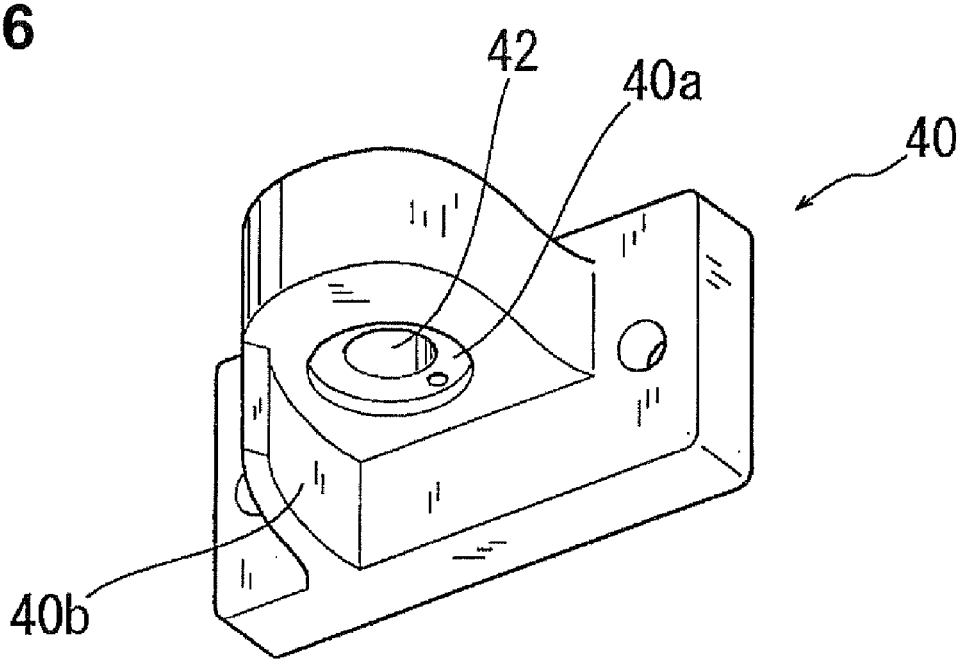
FIG. 16 is a perspective view of a holding bracket shown in FIG. 15.
Figure 17:
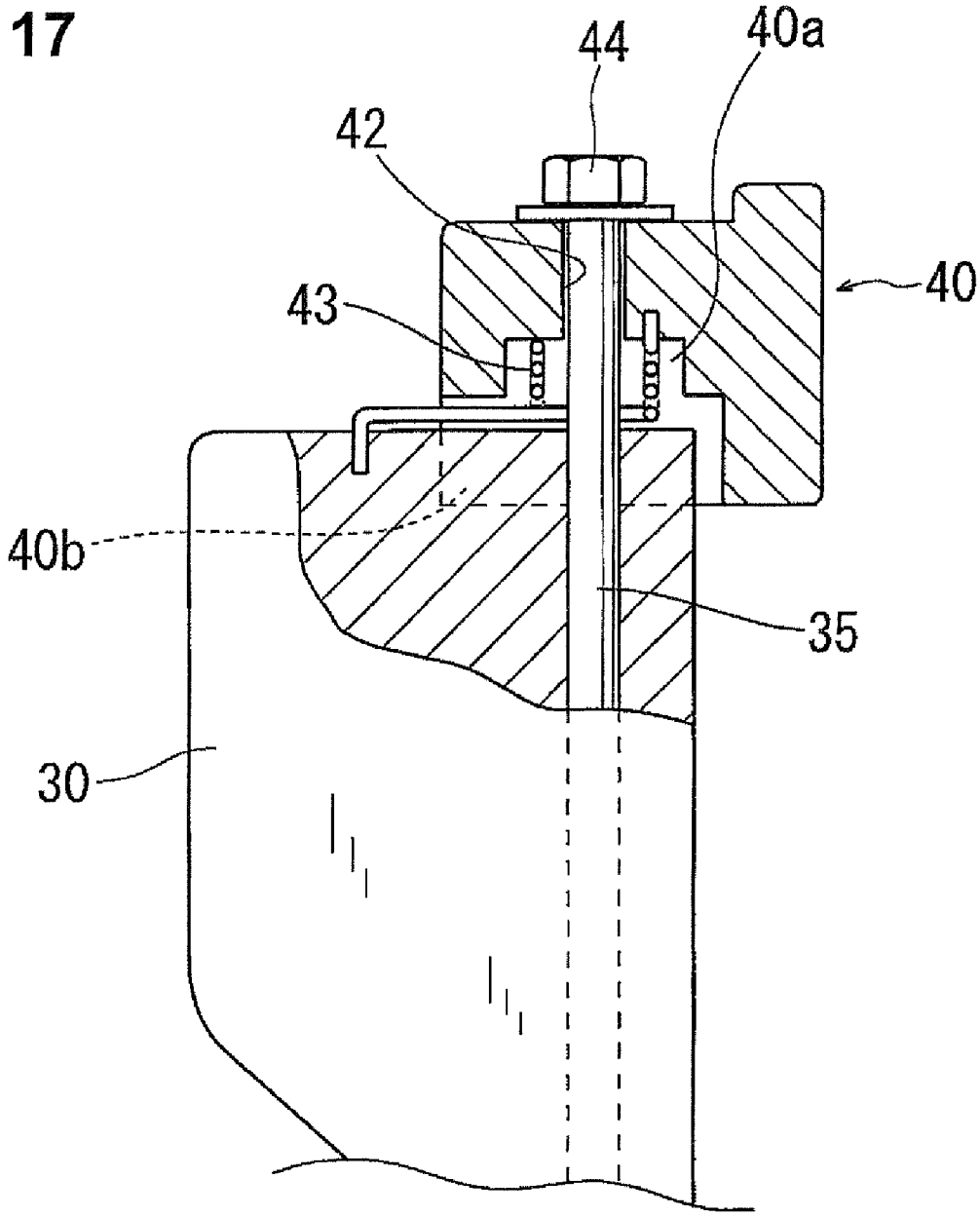
FIG. 17 is a sectional view of the major portion showing an attachment relation between the cover member and the holding bracket.

FIGS. 15 through 17 show a third embodiment of the present invention. Herein, the same structure elements as those in the above-described first embodiment are denoted by the same reference characters, and duplicated descriptions on those are omitted here. In the present, a stopper portion 40*b* is formed at the holding bracket 40 so as to project downward, which prevents the cover member 30 from rotating beyond a specified range. The lower holding bracket 40 has also this stopper portion 40*b*. Thus, the prevention of the cover member 30 beyond the specified range can be achieved surely by the both stopper portions 40*b*.

The present invention should not be limited to the above-described embodiments, and any other modifications may be applied within the scope of a sprit of the present invention. For example, the cover member 30 may be comprised of vertically-split parts. In this case, the gap S may be preferably covered in a properly wide range in the vehicle width direction, providing an easy adjustment for change in a vertical-direction contour of the rear-edge front face portion 3*a*. Any type of detection sensor may be used, not limited to the above-described pressure sensitive switch 50. In case of using a photo sensor, a detection ray is emitted toward the gap S. And the sensor is configured such that the detection ray is directly received, or its reflected ray is received. Herein, if part of the ray is not received, it may be determined that any foreign matter comes into the gap S.

What is claimed is:

1. A pinch prevention structure of a slide door, comprising:

the slide door provided to be movable between a closed position in which the slide door covers a side opening formed at a vehicle-body side face and an open position in which the slide door opens the side opening, the slide door being configured to move outward and subsequently slide rearward along a rear vehicle-body outer face when the slide door moves from the closed position to the open position, a gap being formed between the slide door and the vehicle-body side face such that the gap is formed between an inner side face of the slide door in the open position and a rear edge portion of the side opening formed at the vehicle-body side face when the slide door is moved from the closed position to the open position;

a drive device operative to drive the slide door so as to move between the closed position and the open position;

a drive control device operative to control the drive device; and a detection sensor operative to detect a state in which a foreign matter moves toward said gap formed between the slide door and the vehicle-body side face from a vehicle-compartment inside, but not pinched in the gap, wherein the drive control device is configured so that a drive of the slide door by the drive device is stopped in case the detection sensor detects said state of the foreign matter when the drive device drives the slide door in the closed position toward the open position.

2. The pinch prevention structure of a slide door of claim 1, wherein the rear edge portion of the side opening includes a rear-edge front face portion that faces forward and a rear-edge side face portion that extends forward from an inside end of the rear-edge front face portion, the rear-edge front face portion and the rear-edge side face portion forming an open edge portion that is recessed toward the vehicle inside, at the open edge portion is provided a cover member that is operative to extend in a vehicle width direction so as to cover part of said gap formed when the slide door is moved from the closed position toward the open position, and said detection sensor is configured to detect said state of the foreign matter when the foreign matter contacts the cover member in an operative position from the front.

3. The pinch prevention structure of a slide door of claim 2, wherein said cover member is comprised of a plate member that extends substantially vertically and configured to operate so as to cover the part of the gap in connection with the slide door moving from the closed position to the open position.

4. The pinch prevention structure of a slide door of claim 3, wherein said cover member is provided so as to rotate around a vertically-extending axis between the operative position in which the cover member extends in the vehicle width direction and a store position in which the cover member extends in a vehicle longitudinal direction, a biasing means for biasing the cover member toward the operative position is provided, and said detection sensor is configured to detect said state of the foreign matter in response to rearward movement of an outside end portion of the cover member in the operative position which receives an outer force from the front that is greater than a biasing force of the biasing means.

5. The pinch prevention structure of a slide door of claim 2, wherein said cover member, which is comprised of a plate member that extends substantially vertically, is supported by a vehicle body at an inside end portion thereof that is held rotatably around a vertically-extending axis so that the cover member moves between the operative position and a store position in which the cover member extends in a vehicle longitudinal direction along the rear-edge side face portion of the open edge portion, a biasing means for biasing the cover member toward the operative position is provided, and the cover member is configured such that the cover member is rotated toward the operative position by the biasing means when the slide door is moved toward the open position from the closed position, while the cover member is pushed by the slide door so as to come to the store position when the slide door is moved toward the closed position from the open position.

6. The pinch prevention structure of a slide door of claim 5, wherein said cover member is configured such that an outside end portion thereof in the operative position has a contour that corresponds to a contour of the inner side face of the slide door.

7. The pinch prevention structure of a slide door of claim 2, wherein an armrest is formed at the inner side face of the slide door so that the armrest projects toward the vehicle-compartment inside, and said cover member is configured to cover the gap at least at a level of an upper face of the armrest.

8. The pinch prevention structure of a slide door of claim 2, wherein an armrest is formed at the inner side face of the slide door so that the armrest projects toward the vehicle-compartment inside, and an outside end portion of the cover member in the operative position has a notch with a contour that corresponds to a contour of the armrest.

9. The pinch prevention structure of a slide door of claim 1, wherein there is provided a cover member that is operative to extend in a vehicle width direction so as to cover at least part of said gap formed when the slide door is moved from the closed position toward the open position, and said detection sensor is configured to detect said state of the foreign matter when said cover member in an operative position is pushed rearward.

10. The pinch prevention structure of a slide door of claim 9, wherein said cover member is comprised of a plate member that extends substantially vertically and configured to operate so as to cover at least part of the gap in connection with the slide door moving from the closed position to the open position.

11. A pinch prevention structure of a slide door, comprising:

the slide door provided to be movable between a closed position in which the slide door covers a side opening formed at a vehicle-body side face and an open position in which the slide door opens the side opening, the slide door being configured to move outward and subsequently slide rearward along a rear vehicle-body outer face when the slide door moves from the closed position to the open position;

a drive device operative to drive the slide door so as to move between the closed position and the open position;

a drive control device operative to control the drive device; and a detection sensor operative to detect a state in which a foreign matter moves toward a gap from a vehicle-compartment inside, wherein said gap is formed between an inner side face of the slide door in the open position and a rear edge portion of the side opening when the slide door is moved from the closed position to the open position, and wherein the drive control device is configured so that a drive of the slide door by the drive device is stopped in case the detection sensor detects said state of the foreign matter when the drive device drives the slide door in the closed position toward the open position, the rear edge portion of the side opening includes a rear-edge front face portion that faces forward and a rear-edge side face portion that extends forward from an inside end of the rear-edge front face portion, the rear-edge front face portion and the rear-edge side face portion forming an open edge portion that is recessed toward the vehicle inside, at the open edge portion is provided a cover member that is operative to extend in a vehicle width direction so as to cover part of said gap formed when the slide door is moved from the closed position toward the open position, and said detection sensor is configured to detect said state of the foreign matter when the foreign matter contacts the cover member in an operative position from the front.

12. The pinch prevention structure of a slide door of claim 11, wherein said cover member is comprised of a plate member that extends substantially vertically and configured to operate so as to cover the part of the gap in connection with the slide door moving from the closed position to the open position.

13. The pinch prevention structure of a slide door of claim 12, wherein said cover member is provided so as to rotate around a vertically-extending axis between the operative position in which the cover member extends in the vehicle width direction and a store position in which the cover member extends in a vehicle longitudinal direction, a biasing means for biasing the cover member toward the operative position is provided, and said detection sensor is configured to detect said state of the foreign matter in response to rearward movement of an outside end portion of the cover member in the operative position which receives an outer force from the front that is greater than a biasing force of the biasing means.

14. The pinch prevention structure of a slide door of claim 11, wherein said cover member, which is comprised of a plate member that extends substantially vertically, is supported by a vehicle body at an inside end portion thereof that is held rotatably around a vertically-extending axis so that the cover member moves between the operative position and a store position in which the cover member extends in a vehicle longitudinal direction along the rear-edge side face portion of the open edge portion, a biasing means for biasing the cover member toward the operative position is provided, and the cover member is configured such that the cover member is rotated toward the operative position by the biasing means when the slide door is moved toward the open position from the closed position, while the cover member is pushed by the slide door so as to come to the store position when the slide door is moved toward the closed position from the open position.

15. The pinch prevention structure of a slide door of claim 14, wherein said cover member is configured such that an outside end portion thereof in the operative position has a contour that corresponds to a contour of the inner side face of the slide door.

16. The pinch prevention structure of a slide door of claim 11, wherein an armrest is formed at the inner side face of the slide door so that the armrest projects toward the vehicle-compartment inside, and said cover member is configured to cover the gap at least at a level of an upper face of the armrest.

17. The pinch prevention structure of a slide door of claim 11, wherein an armrest is formed at the inner side face of the slide door so that the armrest projects toward the vehicle-compartment inside, and an outside end portion of the cover member in the operative position has a notch with a contour that corresponds to a contour of the armrest.

* * * * *